United States Patent [19]

Brentham

[11] 4,441,708

[45] Apr. 10, 1984

[54] DOUBLE LEG CURL EXERCISING DEVICE

[76] Inventor: Jerry D. Brentham, P.O. Box #599, Belton, Tex. 76513

[21] Appl. No.: 304,766

[22] Filed: Sep. 23, 1981

Related U.S. Application Data

[63] Continuation of Ser. No. 959,688, Nov. 13, 1978, abandoned, which is a continuation-in-part of Ser. No. 914,356, Jun. 12, 1978, Pat. No. 4,254,949.

[51] Int. Cl.[3] ..... A63B 21/00

[52] U.S. Cl. ..... 272/130

[58] Field of Search ..... 272/130, 134, 136, 142, 272/144, 117

[56] References Cited

U.S. PATENT DOCUMENTS

| | | | |
|---|---|---|---|
| 1,902,694 | 3/1933 | Edwards . | |
| 2,068,578 | 1/1937 | Stronach . | |
| 2,825,563 | 3/1958 | Lawton . | |
| 2,855,199 | 10/1958 | Noland . | |
| 3,000,632 | 9/1961 | Fuchs . | |
| 3,103,357 | 9/1963 | Berne . | |
| 3,120,954 | 2/1964 | Apostol . | |
| 3,285,070 | 11/1966 | McDonough . | |
| 3,465,592 | 9/1969 | Perrine | 272/130 X |
| 3,495,824 | 2/1970 | Cuinier | 272/130 |
| 3,567,218 | 3/1971 | Johnson . | |
| 3,784,194 | 1/1974 | Perrine | 272/130 X |
| 3,822,599 | 7/1974 | Brentham | 272/130 X |
| 3,861,677 | 1/1975 | Wheeldon . | |
| 3,976,057 | 8/1976 | Barclay . | |
| 4,098,502 | 7/1978 | Faust . | |
| 4,227,689 | 10/1980 | Keiser | 272/130 |
| 4,247,098 | 1/1981 | Brentham | 272/130 |
| 4,254,949 | 3/1981 | Brentham . | |

OTHER PUBLICATIONS

"Centurion DVR"—Universal Exercise Equipment 1980-1981 Catalogue, p. 11.

"Real Runner"—Universal Gym Machines, 1974, p. 5.

"Time Machines by Nautilus" insert to Iron Man Magazine, Jul. 1973, pp. 1, 42 and 49.

Universal Gymnastics Catalog, p. 28, 1974, Universal Athletics Sales, Fresno, Calif.

*Primary Examiner*—Richard J. Apley

*Assistant Examiner*—William R. Browne

*Attorney, Agent, or Firm*—Gerald G. Crutsinger; John F. Booth; Monty L. Ross

[57] ABSTRACT

A leg exercising device having a general frame having an L-shaped seat for supporting the body and a pair of leg gripping frames pivotally secured to the general frame such that the axis of rotation of the leg gripping frames are aligned with the pivot point of the knee of the user. The leg gripping frames have resilient pads which allow the leg to pass therethrough such that the leg is padded from the frame as it moves in both directions. A power cylinder is pivotally secured between the general frame and each of the leg gripping frames about the axis of rotation in both directions. Each of the leg gripping frames may be moved independently of each other.

8 Claims, 6 Drawing Figures

DOUBLE LEG CURL EXERCISING DEVICE

CROSS REFERENCE TO RELATED APPLICATIONS

This application is a continuation of my copending application Ser. No. 959,688, filed Nov. 13, 1978, now abandoned, which was a continuation in part of Ser. No. 914,356, filed June 12, 1978, now U.S. Pat. No. 4,254,949 which issued Mar. 10, 1981, entitled Leg Curl Exercising Device.

BACKGROUND

Exercising devices generally serve two purposes, to strengthen the muscles and to rehabilitate the muscles. To prevent injuries from occuring to the knee it is important that athletes involved in contact sports strengthen the muscles controlling the knee. The most efficient way to strengthen the muscles in the knee is to isolate the knee muscles from the nest of the body for effective exercising.

Heretofore, devices which are designed to strengthen the knee generally comprise devices having a series of pulleys and ropes for lifting weight. The devices tend to exercise in only a single direction and furthermore cannot be released at any point except the lowermost point of the weight.

Other devices such as those disclosed in U.S. Pat. Nos. 3,120,954; 3,465,592; 3,495,824; and 3,822,599 generally use sophisticated hydraulic structures and pumps which add to the cost and complexity of the device and thereby reduce their availability to the general public.

SUMMARY

I have devised a knee exercising device comprising a general frame adapted to sit on the floor and support the body. A seat support and a back support are secured to the general frame at an obtuse angle to each other and form a body support for supporting the user.

Actuating means such as a pair of leg gripping frames are pivotally secured to the general frame such that the axis of pivotal movement of each is aligned with the axis of pivotal movement of the leg of the user. Actuated means, such as a double resistant power cylinder, is pivotally secured between the general frame and each of the leg gripping frames such that pivotal movement of the leg gripping frames by the leg of the user is resisted.

The leg gripping frames generally comprise an outwardly extending support arm having a lug formed on the end thereof to support a pair of pads rotatably secured to the lug and adapted to engage opposed sides of the leg of the user. The sets of pads are affixed to each leg and extend inwardly such that both legs of the user may be positioned in a set of pads and moved independently of the other leg.

A body restraint arm generally comprising an upwardly extending hand grip is adapted to restrain forward movement of the body upon movement of the legs upwardly.

A primary object of the invention is to provide a leg exercising device which isolates the leg muscles to efficiently strengthen the leg muscles to prevent injuries to athletes while they are engaged in sporting activities and which isolates each leg of the user to permit unilateral and bilateral exercising of leg.

A further object of the invention is to provide a simple efficient leg exercising device which is completely controlled by the user to minimize the possibility of injury to the user if he becomes exhausted or tired.

A still further object of the invention is to provide a leg exercising device which requires extended output by the muscles of the user to move the leg in each direction and which orients the leg gripping device such that the axis of rotation is aligned with the axis of rotation of the knee to minimize strain on the knee.

Other and further objects of the invention will become apparent upon referring to the detailed description following and the drawings annexed hereto.

DESCRIPTION OF THE DRAWINGS

Drawings of a preferred embodiment of the invention are annexed hereto so that the invention may be more fully understood, in which.

Numeral references are employed to designate like parts throughout the various figures of the drawings.

DESCRIPTION OF A PREFERRED EMBODIMENT

Figure 1:
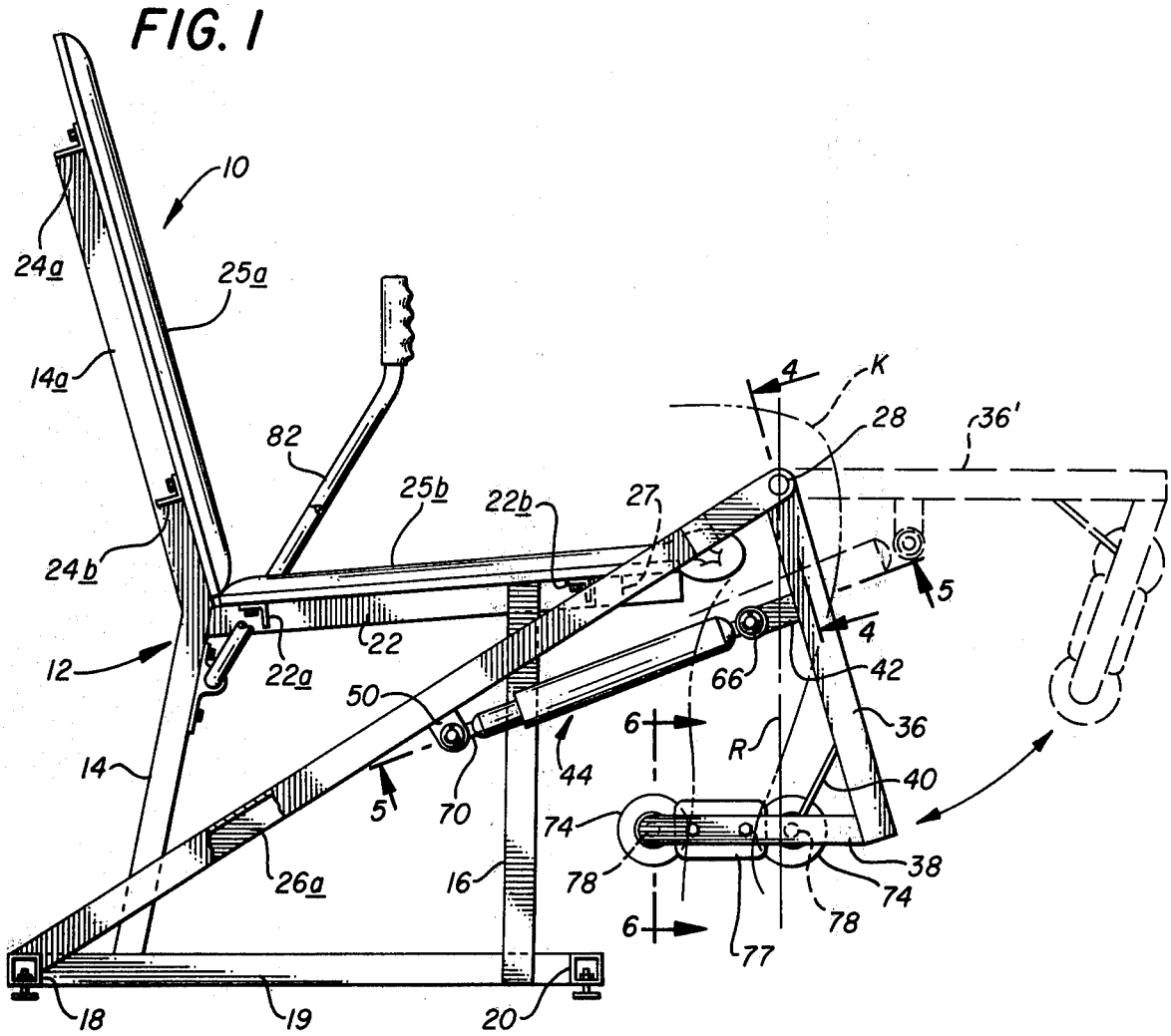
FIG. 1 is an elevational view of the leg exercising device.
Figure 2:
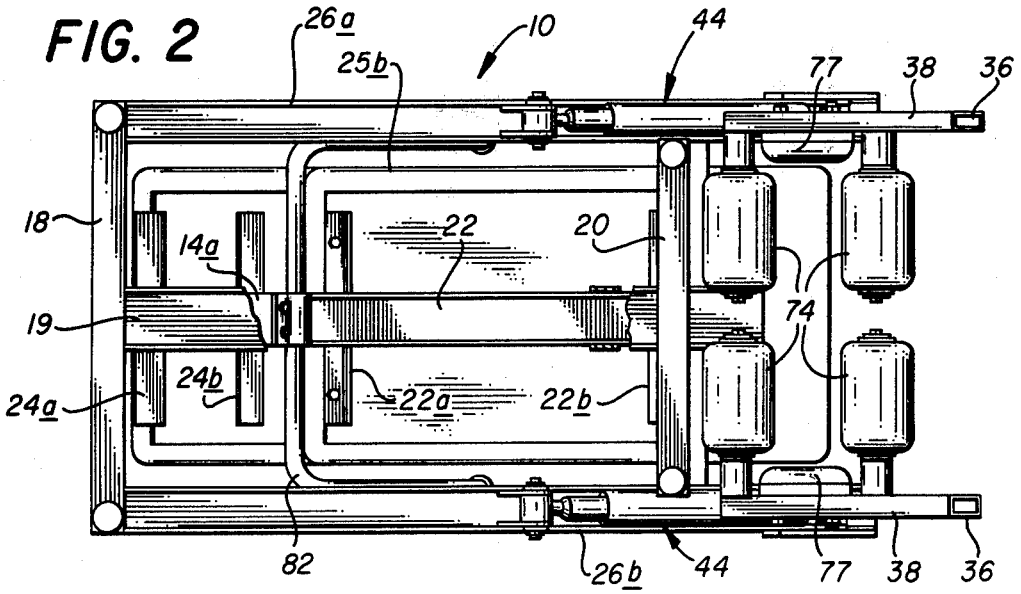
FIG. 2 is a bottom plan view thereof with parts broken away to more clearly illustrate the details of construction.
Figure 3:
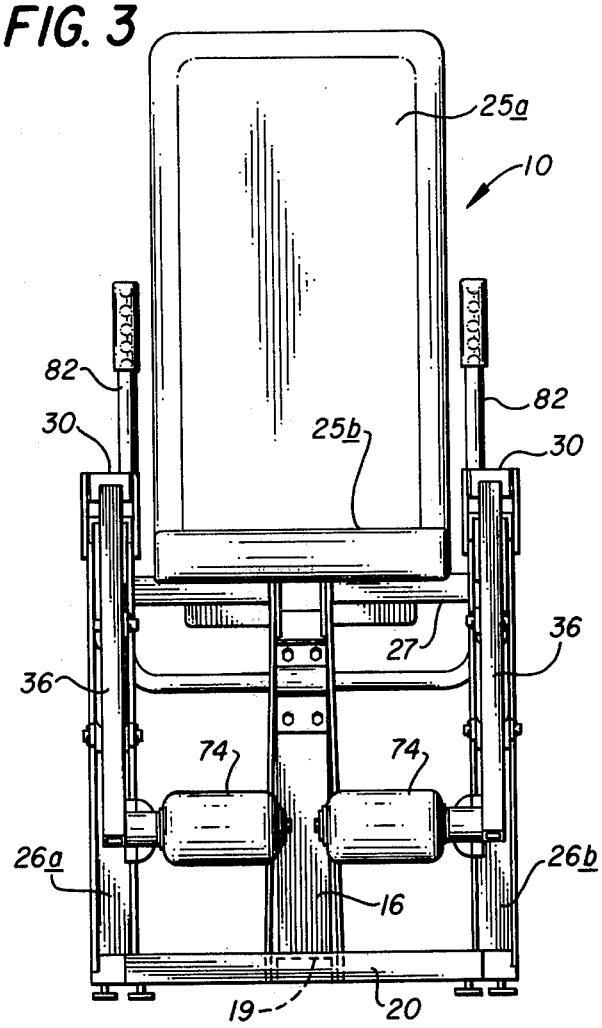
FIG. 3 is a front elevational view thereof.

Referring to FIGS. 1 and 2 of the drawings, the numeral 10 generally designates a leg curl exercising device.

The leg curl exercising device 10 generally comprises a frame 12 having a generally vertical rear leg 14 and a front leg 16 which are secured to a base. The base comprises a rear end member 18 secured in substantially perpendicular relationship to connector member 19 secured to a perpendicular front end member 20.

Rear leg 14 and front leg 16 are secured to an upper longitudinal support member 22 which is secured between legs 14 and 16. Rear leg 14 has a deflected upper portion **14*a* to form a vertical support. Upper support members 22 and 14*a* are generally parallel to the longitudinal axis of the leg curl exercising device 10. Cross-members 24*a* and 24*b* provide a support for back support member 25*a* generally comprising a cushion secured to a flat, rectangular support. Cross-members 22*a* and 22*b* secured to longitudinal member 22 provide support for the seat support member 25*b*** generally comprising a cushion secured to a flat, rectangular support.

It should be appreciated that back support member **25*a* is preferably positioned at an obtuse angle slightly greater than ninety degrees to seat support 25*b*** to place the body in a position such that the upper torso is slightly bent forward from the hip which corresponds to the position in which the body is generally placed when working or engaging in sporting activities.

It should be noted from FIG. 1 of the drawing that front leg member 16 is preferably set in from the front portion of the seat support **25*b* and longitudinal upper support 22. A transverse front support member 27 is secured to the front end of longitudinal support 22 and extends outwardly from seat support 25*b*** on each side.

Angularly disposed support arms 26*a* and 26*b* are secured to each side of rear end member 18 of the base to transverse support member 27 and extend upwardly past seat support 25*b*. The arms 26*a* and 26*b* comprise C-shaped channels which have a clevis formed on the upper ends.

Figure 4:
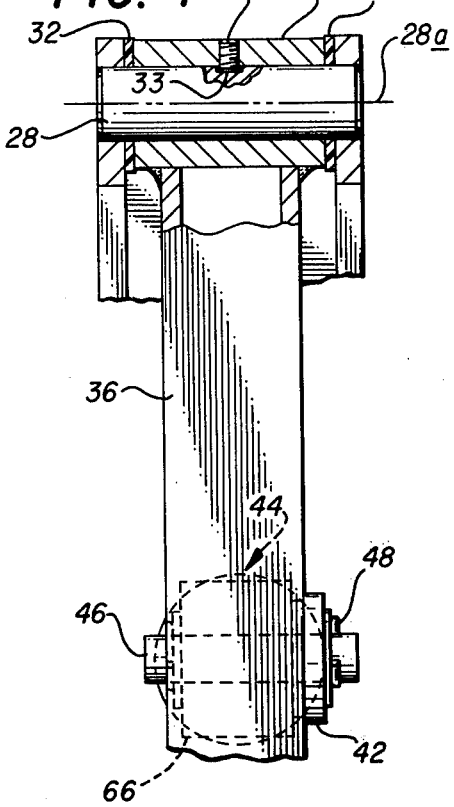
FIG. 4 is an enlarged cross-sectional view taken along line 4—4 of FIG. 1.

Actuating means, such as a leg gripping frame, generally comprises a pair of outwardly extending support arms 36 welded or otherwise secured to a sleeve 30 (FIG. 4) which is rotatably disposed on shafts 28 between bushings 32 and 34 secured between the side of each arm 26*a* and 26*b*. A set screw 31 is threadedly secured through sleeve 30 into a passage 33 formed in shaft 28. The ends of shaft 28 are preferably substantially flush with the sides of arm 26*a* or 26*b* so as not to interfere with the user.

It should be readily apparent from the drawings that the axes of rotation 28*a* of shafts 28 and arms 36 are preferably aligned with the axis of rotation of the knee K which when the user positions his body supports 25*a* and 25*b* is substantially aligned therewith. As shown in dashed outline, the knee K bends at the axis of rotation 28*a*.

Arms 36 have a rearwardly extending arm 38 secured to the end thereof to form a substantially L-shaped member and has an angular brace 40 to strengthen the leg gripping means. Arm 38 is preferably oriented such that it is substantially perpendicular to a radial line R passing through the axis of rotation of shaft 28 and the knee K so as to minimize strain on the knee and maximize stress on the muscles for bending the leg.

The actuating means further comprises leg engagement means such as a pair of padded rollers 74 rotatably secured to inwardly disposed shafts 78 rigidly secured to each of arms 38. Washers 80 are secured on each side of rollers 74. Bolt 76 is threadedly secured in the end of shaft 78 to limit longitudinal movement of rollers 74 relative to shaft 78. The rollers 74 are oriented on arm 38 so as to engage opposed sides of each leg L shown in dashed outline. A pair of rollers 74 are disposed on each arm 38 in a like manner. Pads 77 are secured to member 38 to protect the legs.

It should be readily apparent from the drawing that the actuating means is movable from a first position shown in full outline in FIG. 1, wherein the knee K is bent at an angle of less than ninety degrees and actuating means is moved under longitudinal support 22, to a second position 36' shown in dashed outline wherein the leg would be substantially straight.

Actuated means or means controlling the rate of movement generally comprises a pair of two-way resistant cylinders 44 pivotally secured between the frame 12 and each of the actuating means arm 36.

The means controlling the rate of movement or cylinder 44 is of a type similar to a standard motorcycle racing shock absorber. The cylinder provides substantially equal resistance to pivotal movement of arms 36 about shafts 28 in both clockwise and counterclockwise directions as viewed in FIG. 1. A cylinder 44 resists movement by the user but does not move the leg of the user.

Figure 5:
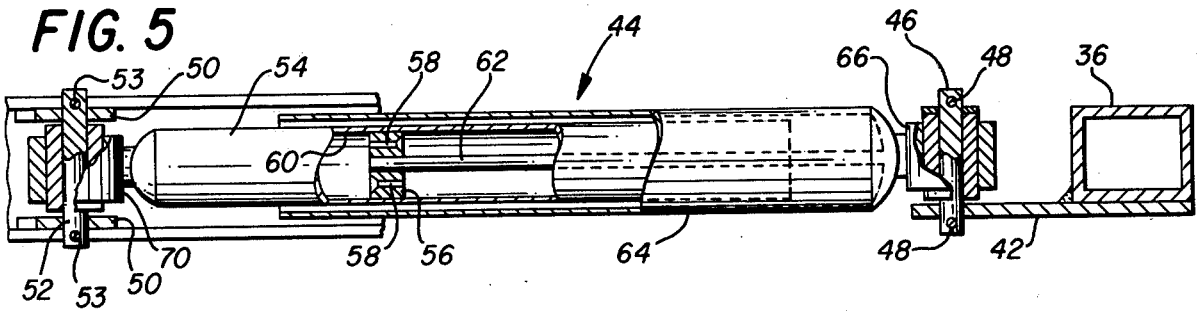
FIG. 5 is an enlarged cross-sectional view taken along line 5—5 of FIG. 1.
Figure 6:
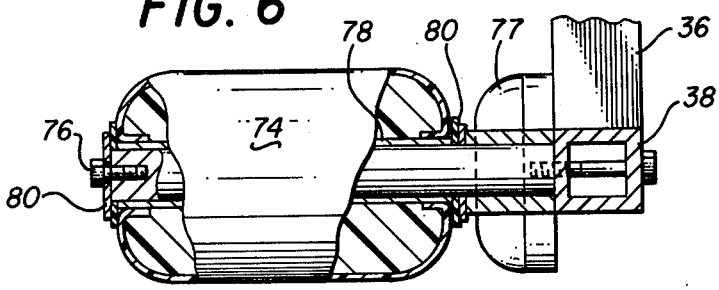
FIG. 6 is a cross-sectional view taken along line 6—6 of FIG. 1.

As illustrated in FIGS. 1, 2 and 5, a first end 66 of a cylinder 44 is secured by shaft 46 in lug 42 welded or otherwise secured to the central portion of one of arms 36. Cotter pins 48 maintain shaft 46 within the clevis 42. A second end 70 is likewise secured in clevis lugs 50 welded to the central lower portion of angular support arm 26*a* or 26*b* and rotatably secured thereto by a pin 52 and cotter pins 53. Cylinders 44 are secured in like manner between each arm 26*a* and 26*b* to a respective arm 36.

Each of the fluid flow resistance means generally comprises a cylindrical shaped chamber 54 having an inner wall 60 through which piston 56 is slideably disposed. Piston 56 is secured to a connecting rod 62 which is secured to the end housing 64 slideably disposed over the exterior of chamber 54 and secured to end 66. Piston 56 has a pair of orifices 58 secured therein in opposed relation to each other for controlling the flow of fluid from the first end of chamber 54 on one side of piston 56 to the other end of chamber 54 on the opposite side of piston 56. The fluid generally comprises a standard fluid such as hydraulic oil, silicone or other similar fluids generally used in shock absorbers.

Upper body restraint means 82 generally comprising upwardly extending arms adapted to provide hand grips for limiting forward motion of the body of the user when lifting the leg to a position shown in dashed outline 36'.

Operation of the hereinbefore described device is as follows:

The user places his body on the body support members 25*a* and 25*b* such that the knee is oriented between shafts 28. The user extends his legs through the respective set of rollers 74 on each of arms 36. He relaxes his body and grips the hand grip and proceeds to apply force to move either or both of arms 36 from first position to the second position 36' shown in dashed outline.

Should for various reasons, such as the size of the user, the knee K is not aligned with shaft 28, rollers 74 will rotate and allow movement of the leg L relative to the rollers 74 as the leg is raised and lowered.

It should be appreciated that the maximum force exerted by the limb or leg is generally decreasing as the leg is straightened due to less leverage of the limb. Further, cylinders 44 control the rate of movement and resist movement with a force substancially equal to the force applied against the cylinder 44 and therefore stresses the leg throughout the full range of movement of the leg to maximize the effect on the leg.

From the foregoing it should be readily apparent that each of the embodiments hereinbefore described accomplishes the objects of the invention hereinbefore discussed.

It should be appreciated that other and further embodiments of the invention may be devised without departing from the basic concept thereof.

Having described my invention, I claim:

1. A leg curl exercising device adapted to strengthen each leg and knees of the user independently of the other, comprising: a support frame; body support members secured to said support frame to support the user; a pair of arms; means pivotally securing said arms to each side of said support frame, said arms being positioned such that an axis of rotation of each arm is aligned with an axis of rotation of each knee; leg gripping means for gripping a user's leg by engaging opposed sides of each leg of a user, said gripping means being secured to the end of each arm adapted to engage opposed sides of each leg of the users; and means controlling the rate of movement pivotally secured between the frame and each arm to independently resist movement of each said arm between a first position wherein each respective leg of the user is at an acute angle and a second position wherein the legs are substantially extended.

2. A leg curl exercising device according to claim 1, with the addition of: upper body restraint arms to limit upper body movement.

3. A leg curl exercising device according to claim 1, wherein leg gripping means comprise: rollers rotatably secured to the end of each arm.

4. A leg curl exercising device according to claim 1, wherein each arm comprises: an L-shaped arm, the extension member of the L being oriented toward the frame, and the pads secured to said extension member.

5. A leg curl exercising device to strengthen the legs and knees of a user, comprising: a support frame; a seat support member on said support frame; a back support member on said support frame, said seat support member and said back support member being oriented relative to one another at an obtuse angle to support the body of a user in a sitting position; a pair of exercise arms to permit independent and combined exercising movement of the legs of the user, each exercise arm being independently and pivotally secured to a side of said support frame with the axis of rotation of the exercise arms being substantially aligned with the axis of rotation of an adjacent knee of the user; leg gripping means secured to the outer end of each arm for gripping a user's leg by engaging opposed sides of each leg of the user; a pair of cylinders having fluid disposed therein; means pivotally securing a first end of each said cylinder to each side of said support frame; a pair of piston rods; means pivotally securing an end of each of said piston rods to one of said arms; a piston slideably disposed in each cylinder and secured to the other end of each piston rod; means resisting flow of fluid from one side of each said piston to the other side of said piston for resisting movement of each arm independently in each direction between a position with the leg below the knee of the user being an an acute angle relative to the leg above the knee and a position with the leg being substantially extended; and hand support means upwardly of the seat support member and forwardly of the back support member on each side of said support frame to limit movement of the body of a user sitting on said seat support member.

6. The combination called for in claim 1 wherein the support frame generally comprises: front and rear legs; an upper longitudinal support member, said front leg being spaced inwardly from said axis of rotation of said actuating means.

7. The combination called for in claim 5 wherein the leg gripping means comprises: padded rollers for engaging the leg of the user on opposed sides of the ankle; and means rotatably securing said padded rollers to each of said arms in a plane substantially perpendicular to a radial line passing through the axis of rotation of the pair of exercise arms.

8. A leg curl exercising device adapted to strengthen each leg and knee of a user independently of the other, comprising: a base; body support means to support a user in a sitting position; front and rear frame legs extending between said base and said body support means; a pair of support members having rear ends secured to opposite sides of said base adjacent said rear legs and having forward ends extending forwardly of said body support means; a pair of arms; means pivotally securing one of said arms to each of said support members to independently resist movement of each arm between a first position wherein each respective leg of the user is at an acute angler and a second position wherein the legs of the user are substantially extended, said arms being positioned such that an axis of rotation of each arm is aligned with an axis of rotation of each knee; leg gripping means secured to the end of each arm to engage opposite sides of the ankle on each leg of a user.

* * * * *